United States Patent [19]

Modin

[11] Patent Number: 4,744,147

[45] Date of Patent: May 17, 1988

[54] SCISSORS WITH INTEGRATED FINGER LOOPS AND STOP

[76] Inventor: Jimmie D. Modin, 728 S. 10th, Salina, Kans. 67401

[21] Appl. No.: 931,257

[22] Filed: Nov. 17, 1986

[51] Int. Cl.[4] ..... B26B 13/00

[52] U.S. Cl. ..... 30/254; 30/232

[58] Field of Search ..... 30/232, 254–262

[56] References Cited

U.S. PATENT DOCUMENTS

| | | | |
|---|---|---|---|
| 1,326,299 | 12/1919 | Smit | 30/256 |
| 2,184,909 | 12/1939 | Crompton | 30/256 |
| 2,382,281 | 8/1945 | Amis | 30/261 |
| 2,708,311 | 5/1955 | McCloud | 30/254 X |
| 3,825,020 | 7/1974 | Myers | 30/254 X |

*Primary Examiner*—Douglas D. Watts

*Attorney, Agent, or Firm*—John Wade Carpenter

[57] ABSTRACT

An apparatus for cutting having a first cutting member pivotally connected to a second cutting member. Each cutting member terminates into a loop. One of the cutting members also includes a pointer loop.

1 Claim, 1 Drawing Sheet

SCISSORS WITH INTEGRATED FINGER LOOPS AND STOP

BACKGROUND OF THE INVENTION

1. Field of the Invention

This invention is related to an apparatus for cutting. More specifically, this invention provides scissors for cutting hair, or the like.

2. Description of the Prior Art

U.S. Pat. No. 328,813 to Roder teaches a buttonhole cutter.

U.S. Pat. No. 726,156 by Goldsmith also teaches a cutter or shears for buttonholes.

U.S. Pat. No. 1,006,936 by Guzman provides a combination of shears for cutting.

Frederick in U.S. Pat. No. 1,080,145 teaches scissors for buttonholes.

U.S. Pat. Nos. 1,205,999 and 2,624,114 to Kirmsee and Althausen, respectively, discloses scissors or shears. None of the foregoing prior art teaches or suggests the particular scissors of this invention.

SUMMARY OF THE INVENTION

The present invention accomplishes its desired objects by broadly providing a cutting apparatus. The apparatus for cutting is scissors that comprise a first cutting member having a pair of ends and a first cutting edge. The first cutting member terminates at one end into a first cutting point, and terminates at another end into a structure defining a thumb loop.

The apparatus for cutting also includes a second cutting member having a pair of ends and a second cutting edge. The second cutting member is pivotally secured to the first cutting member. The second cutting member also terminates at one end into a second cutting point and terminates at another end into a structure defining a finger loop. The finger loop has integrally bounded thereto and extending therefrom a finger brace having a geneally arcuate shape. The second cutting member additionally includes a structure defining a pointer loop.

Therefore, it is an object of the present invention to provide scissors.

It is another object of this invention to prepare scissors which are relatively inexpensive to manufacture.

It is yet another object of this invention to provide the scissors that have a structure which enables the user to make a more accurate cut while being held in comfort by the user.

These, together with various ancillary objects and features which will become apparent to those skilled in the art as the following description proceeds, are attained by this novel scissors, a preferred embodiment being shown with reference to the accompanying drawings, by way of example only, wherein:

DETAILED DESCRIPTION OF THE INVENTION

Figure 1:
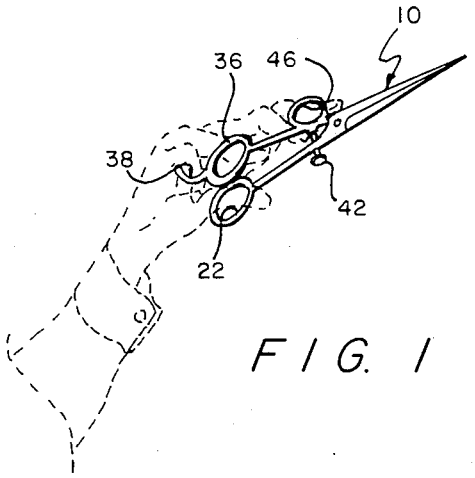
FIG. 1 is a perspective view of the scissors of this invention being held by the hand of a user whose hand is represented as dotted lines.

Referring in detail now to the drawings, there is seen the scissors of this invention, generally illustrated as 10. Scissors 10 has a first cutting member 12 with ends generally illustrated as 14 and 16. First cutting member 12 also has a cutting edge 18. End 14 defines a first cutting point 20, and end 16 defines a thumb loop 22. First cutting member 12 includes a first shank 21 which has the thumb loop 22 at an end.

Scissors 10 also has a second cutting member 26 that is pivotally secured to the first cutting member 12 by a screw 26 at their respective mid-points. The second cutting member 24 has ends, generally illustrated as 28 and 30, and a cutting edge 32. The respective mid-points of the first cutting member 12 and the second cutting member 26 are between their respective ends, 14 and 16, and 28 and 30. Ends 28 and 30 respectively define a second cutting point 34 and a finger loop 36 that as a center A. Finger loop 36 has integrally bound thereto and extending therefrom an arcuate shaped brace 38. Second cutting member 26 has a second shank 27 with shank sides 27*s*′ and 27*s*″. Second shank 27 terminates in the finger loop 36.

Figure 3:
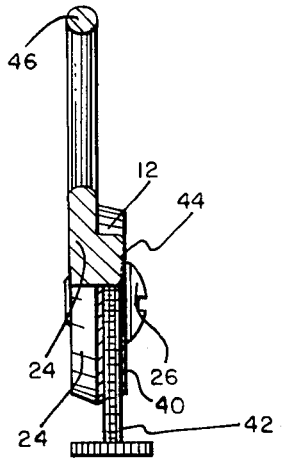
FIG. 3 is a vertical sectional view taken in direction of the arrows and along the plane of line 3—3 in FIG. 2.
Figure 2:
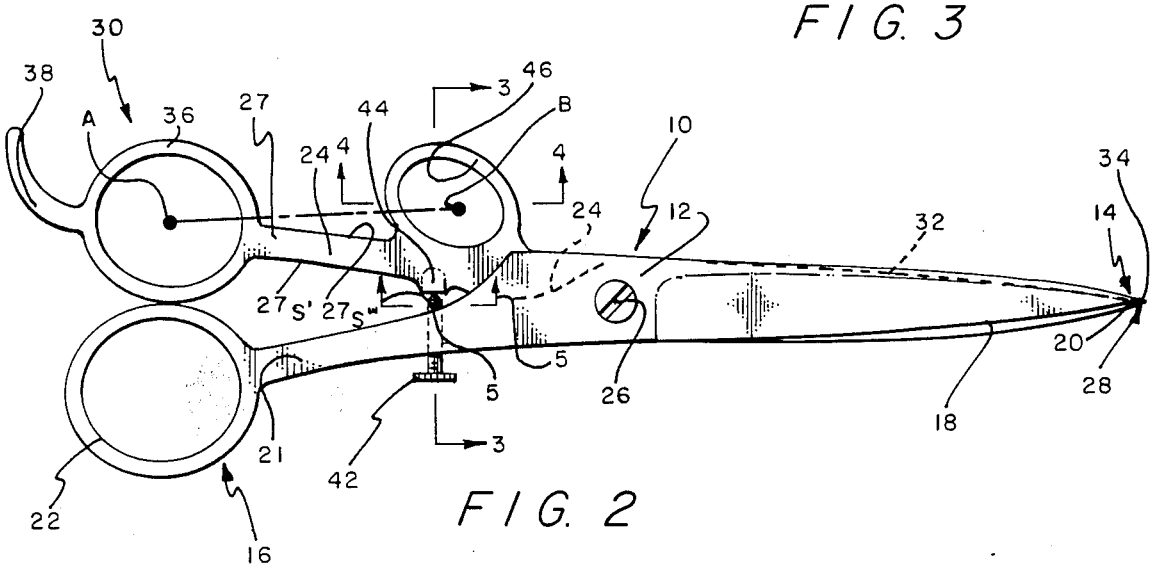
FIG. 2 is a side elevational view of the scissors of this invention.
Figure 4:
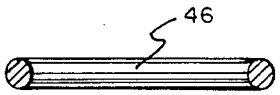
FIG. 4 is a horizontal sectional view taken in direction of the arrows and along the plane of line 4—4 in FIG. 2.
Figure 5:
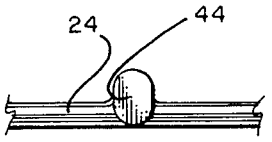
FIG. 5 is a horizontal sectional view taken in direction of the arrows and along the plane on line 5—5 in FIG. 2.

The first cutting member 12 has a threaded aperture 40 extending entirely through its first shank structure between its midpoint at screw 26 and the thumb loop 22. An adjusting screw 42 threadably engages the threaded aperture 40 to bear on a bearing surface 44 that is an integral part of shank side 27*s*′ of the second cutting member 24 (see FIGS. 2 and 3) in order to regulate the alignment of the cutting points 20 and 34 with respect to each other. The bearing surface 44 protrudes from the second cutting member 24 between its midpoint at screw 26 and the finger loop 36 to mate contactly with the end of the adjusting screw 42 to accomplish the regulation of the alignment.

The first cutting member 12 also has integrally bound thereto on shank side 27*s*″ of the second shank 27 a pointer loop 46 for receiving the pointer finger of a user. Pointer loop 46 has a center B and is structurally opposed to adjusting screw 42 and, like the adjusting screw 42, is located on the first cutting member 12 between its mid-point and the finger loop 36. Finger loop 36 and pointer loop 46 on the second shank 27 are spaced from each other. The bearing surface 44 protrudes away from shank side 27*s*′ in a direction away from the pointer loop 46, and, furthermore, the bearing surface 44 is integrally bound to the shank side 27*s*′ at a point immediately opposed to the pointer loop 46.

One of the important features of this invention is that the pointer loop 46 is integrally bound to the first cutting member 12 such that when the user positions the pointer finger (see FIG. 1) through the pointer loop 46, the scissors 10 substantially balance horizontally without tilting to one side. With such features, the scissors 10 may be held in comfort and produces a more accurate cut. Also, with such features, the scissors 10 may be positioned more accurately to produce a more accurate cut. To accomplish such features, a plane through the center A of finger loop 36 and center B of pointer loop 46 is generally horizontal (see dotted lines in FIG. 2). By manufacturing the scissors 10 with the centers A and B being located with respect to each as such, the scissos 10 for cutting hair is generally balanced when held by the user.

While the present invention has been described herein with reference to particular embodiments thereof, and specific examples a latitude of modification, various changes and substitutions are intended in the foregoing disclosure, and in some instances some features of the invention will be employed without a corresponding use of other features without departing from the scope of the invention.

I claim:

1. An apparatus for cutting hair comprising a first cutting member having a first shank and a first cutting edge, said first cutting member terminates at one end in a first cutting point, and said first shank terminates at an end in a structure defining a thumb loop;

a second cutting member having a second shank with a pair of shank sides and a second cutting edge and pivotally secured to said first cutting member, said second cutting member terminates at one end in a second cutting point and said second shank terminates at one end in a structure defining a finger loop having integrally bound thereto and extending therefrom a finger brace with a generally arcuate shape, and said second cutting member additionally includes a structure defining a pointer loop bound to one shank side of said second shank and spaced on said second shank from said finger loop; a bearing surface integrally bound to the other shank side at a point immediately opposed to said pointer loop, said bearing surface protrudes away from said other shank side in a direction away from said pointer loop;

said first cutting member has a mid-point between its ends, and said second cutting member has a mid-point between its ends, and said first cutting member and said second cutting member are pivotally secured to each other at their respective mid-point;

said first shank has a threaded aperture extending entirely through its structure between its mid-point and the thumb loop, an adjusting screw means extends rotatably through said threaded aperture in said first shank and engages said bearing surface in order to regulate the alignment of said first cutting point and said second cutting point with respect to each other; and said finger loop has a finger loop center and said pointer loop has a pointer loop center such that a plane through said finger loop center and said pointer loop center is generally horizontal in order for the apparatus for cutting hair to be generally balanced when held by the user.

* * * * *